US011106156B2

(12) United States Patent
Inoue

(10) Patent No.: US 11,106,156 B2
(45) Date of Patent: Aug. 31, 2021

(54) IMAGE FORMING APPARATUS WITH PROCESS CARTRIDGE STORING SETS OF INFORMATION THAT ASSOCIATE IDENTIFICATION INFORMATION AND CONTROL INFORMATION

(71) Applicant: CANON KABUSHIKI KAISHA, Tokyo (JP)

(72) Inventor: Naoki Inoue, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/674,260

(22) Filed: Nov. 5, 2019

(65) Prior Publication Data

US 2020/0150560 A1 May 14, 2020

(30) Foreign Application Priority Data

Nov. 8, 2018 (JP) ..... JP2018-210926

(51) Int. Cl.
*G03G 15/08* (2006.01)
*G03G 21/18* (2006.01)

(52) U.S. Cl.
CPC ..... *G03G 15/0863* (2013.01); *G03G 21/1896* (2013.01)

(58) Field of Classification Search
CPC ..... G03G 15/0863; G03G 21/1896
See application file for complete search history.

(56) References Cited

U.S. PATENT DOCUMENTS

2002/0021906 A1* 2/2002 Yoshizaki ..... G03G 21/1889 399/12
2018/0117920 A1* 5/2018 Panshin ..... G06F 3/1203

FOREIGN PATENT DOCUMENTS

JP 2003-084631 A 3/2003

* cited by examiner

*Primary Examiner* — Joseph S Wong
(74) *Attorney, Agent, or Firm* — Venable LLP

(57) ABSTRACT

An image forming apparatus in which a cartridge is detachably mounted, wherein the cartridge includes: a storage unit that stores one or a plurality of sets of information associating identification information assigned according to a classification for image forming apparatus with control information used to control the image forming apparatus, and a management unit that, in response to a request from an image forming apparatus in which the cartridge is mounted, provides information stored in the storage unit; and the image forming apparatus comprises: a holding unit that holds identification information assigned to the image forming apparatus itself, and an acquisition unit that, with the identification information held in the holding unit, requests to and acquire from the cartridge corresponding control information.

9 Claims, 10 Drawing Sheets

FIG. 3A
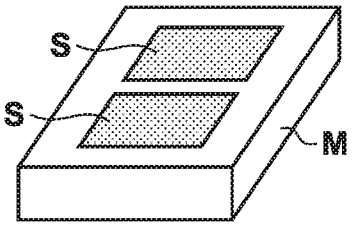
FIG. 3B
| CONFIGURATION IDENTIFICATION NUMBER | TRANSFER CORRECTION PARAMETER |
|---|---|
| 1 | 10 |
| 2 | 30 |
| 3 | 25 |
| ⋮ | ⋮ |
| 16 | 20 |
| ⋮ | ⋮ |
| 32 | 45 |
301
FIG. 3C
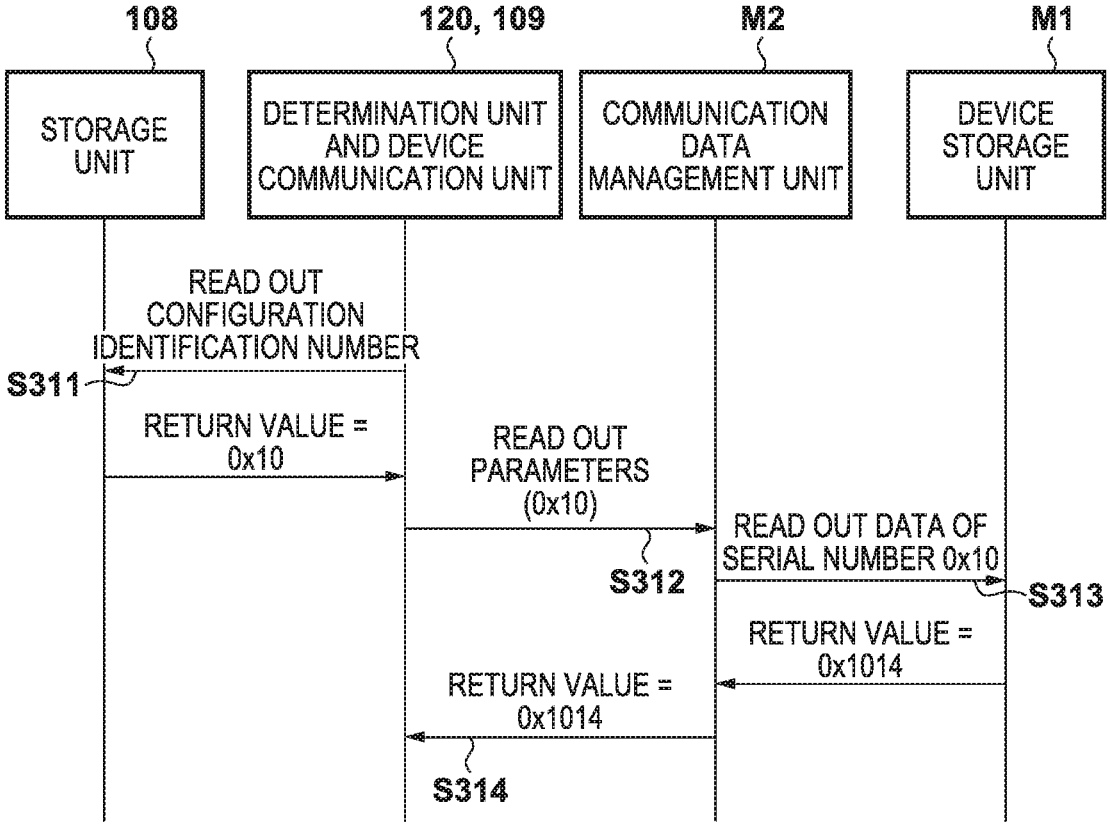

| CONFIGURATION IDENTIFICATION NUMBER | TRANSFER CORRECTION PARAMETER |
|---|---|
| 1 | 10 |
| 2 | 30 |
| 3 | 25 |
| ⋮ | ⋮ |
| 16 | 20 |
| ⋮ | ⋮ |
| 32 | 45 |
| 33 | 90 |

FIG. 6A

| MODEL IDENTIFICATION NUMBER | CONFIGURATION IDENTIFICATION NUMBER | AUTHENTICATION INFORMATION | |
|---|---|---|---|
| 1 | 1 | 0x1111 | 604 |
| 2 | 1 | 0x0123 | |
| 2 | 2 | 0x4567 | |
| ⋮ | ⋮ | ⋮ | |
| 2 | 16 | 0x89AB | 605 |
| 3 | 1 | 0x3210 | |
| 3 | 2 | 0x7654 | |
| ⋮ | ⋮ | ⋮ | |
| 3 | 16 | 0xBA98 | 607 |
| ⋮ | ⋮ | ⋮ | |
| 3 | 32 | 0xFEDC | 606 |

601

602

603

IMAGE FORMING APPARATUS WITH PROCESS CARTRIDGE STORING SETS OF INFORMATION THAT ASSOCIATE IDENTIFICATION INFORMATION AND CONTROL INFORMATION

BACKGROUND OF THE INVENTION

Field of the Invention

The present invention relates to an image forming apparatus, a control method thereof, a cartridge, and a storage device.

Description of the Related Art

In the related art, there is a cartridge detachably mounted in the main bodies of a plurality of types of image forming apparatus. Japanese Patent Laid-Open No. 2003-84631 describes, as to a cartridge which can be mounted in a plurality of types of image forming apparatus, a method of forming an image by storing process condition parameters, for each type of image forming apparatus, in a storage device of the cartridge, thereby correcting the process condition to an appropriate process condition for any type of cartridge.

However, when the optimum control parameters differ depending on the shipping region of the image forming apparatus, and the mounted parts, more control parameters are stored in the storage device, accordingly. In order to read out all these control parameters and find out the optimum control parameters for the image forming apparatus in which the process cartridge is mounted from the storage device of the cartridge, a large number of communication buffers and a communication time are required.

Also, there is a possibility that the shipping region and the mounted parts are newly added after the production of the image forming apparatus is started. When the image forming apparatus reads out a previously specified range of information stored in the storage device of the cartridge, the newly added control parameter cannot be read out.

SUMMARY OF THE INVENTION

In view of the above problems, an object of the present invention is to read out a control parameter corresponding to a configuration of an image forming apparatus in which the cartridge is mounted from many control parameters stored in a storage device by data communication with a small load.

According to one aspect of the present invention, there is provided an image forming apparatus in which a cartridge is detachably mounted, wherein the cartridge includes: a storage unit configured to store one or a plurality of sets of information associating identification information assigned according to a classification for image forming apparatus with control information used to control the image forming apparatus, and a management unit configured to, in response to a request from an image forming apparatus in which the cartridge is mounted, provide information stored in the storage unit; and the image forming apparatus comprises: a holding unit configured to hold identification information assigned to the image forming apparatus itself, and an acquisition unit configured to, with the identification information held in the holding unit, request to and acquire from the cartridge corresponding control information.

According to another aspect of the present invention, there is provided an image forming apparatus in which a cartridge is detachably mounted, wherein the cartridge includes: a storage unit configured to store one or a plurality of sets of information associating a plurality of pieces of identification information assigned according to each of a plurality of classifications for image forming apparatus with control information used to control the image forming apparatus, and a management unit configured to, in response to a request from an image forming apparatus in which the cartridge is mounted, provide information stored in the storage unit; and the image forming apparatus comprises: a holding unit configured to hold a plurality of pieces of identification information assigned to the image forming apparatus itself, and an acquisition unit configured to, with the plurality of pieces of identification information held in the holding unit, request to and acquire from the cartridge corresponding control information.

According to another aspect of the present invention, there is provided a cartridge detachably mounted in an image forming apparatus, comprising: a storage unit configured to store one or a plurality of sets of information associating identification information assigned according to a classification for image forming apparatus with control information used to control the image forming apparatus; and a management unit configured to, in response to a request from an image forming apparatus in which the cartridge is mounted, provide control information stored in the storage unit corresponding to identification information indicated by the request.

According to another aspect of the present invention, there is provided a cartridge detachably mounted in an image forming apparatus, comprising: a storage unit configured to store one or a plurality of sets of information associating a plurality of pieces of identification information assigned according to each of a plurality of classifications for image forming apparatus with control information used to control the image forming apparatus; and a management unit configured to, in response to a request from an image forming apparatus in which the cartridge is mounted, provide information stored in the storage unit; wherein the request is made with information based on at least one of the plurality of classifications.

According to another aspect of the present invention, there is provided a storage device included in a cartridge that is detachably mounted in an image forming apparatus, the storage device comprising: a storage unit configured to store one or a plurality of sets of information associating identification information assigned according to a classification for image forming apparatus with control information used to control the image forming apparatus; and a management unit configured to, in response to a request from an image forming apparatus in which the cartridge is mounted, provide control information stored in the storage unit corresponding to identification information indicated by the request.

According to another aspect of the present invention, there is provided a storage device included in a cartridge that is detachably mounted in an image forming apparatus, the storage device comprising: a storage unit configured to store one or a plurality of sets of information associating a plurality of pieces of identification information assigned according to each of a plurality of classifications for image forming apparatus with control information used to control the image forming apparatus; and a management unit configured to, in response to a request from an image forming apparatus in which the cartridge is mounted, provide information stored in the storage unit; wherein the request is made with information based on at least one of the plurality of classifications.

According to another aspect of the present invention, there is provided a control method of an image forming apparatus in which a cartridge is detachably mounted, wherein the cartridge includes a storage unit configured to store one or a plurality of sets of information associating identification information assigned according to a classification for image forming apparatus with control information used to control the image forming apparatus, the image forming apparatus includes a holding unit configured to hold identification information assigned to the image forming apparatus itself, and in the image forming apparatus, when a request is made to the cartridge with the identification information held in the holding unit, control information corresponding to the identification information among the information stored in the storage unit is provided from the cartridge, as a response to the request.

According to another aspect of the present invention, there is provided a control method of an image forming apparatus in which a cartridge is detachably mounted, wherein the cartridge includes a storage unit configured to store one or a plurality of sets of information associating a plurality of pieces of identification information assigned according to each of a plurality of classifications for image forming apparatus with control information used to control the image forming apparatus the image forming apparatus includes a holding unit configured to hold a plurality of pieces of identification information assigned to the image forming apparatus itself, and in the image forming apparatus, when a request is made to the cartridge with the plurality of pieces of identification information held in the holding unit, control information corresponding to the plurality of pieces of identification information among the information stored in the storage unit is provided from the cartridge, as a response to the request, and the request is made with information based on at least one of the plurality of classifications.

According to the present invention, control parameters corresponding to the configuration of the image forming apparatus can be read out from the recording device by data communication with a small load.

Further features of the present invention will become apparent from the following description of exemplary embodiments (with reference to the attached drawings).

BRIEF DESCRIPTION OF THE DRAWINGS

FIGS. 3A to 3C are diagrams illustrating an example of data configuration and a sequence of a storage device according to the first embodiment.

FIGS. 6A and 6B are diagrams illustrating an example of data configuration and a sequence of a storage device according to a second embodiment.

DESCRIPTION OF THE EMBODIMENTS

Hereinafter, an embodiment of the present invention will be described with reference to the drawings. It should be noted that the configuration of each embodiment described below is merely an example, and is not intended to be limited thereto.

First Embodiment

Device Configuration

Figure 1:
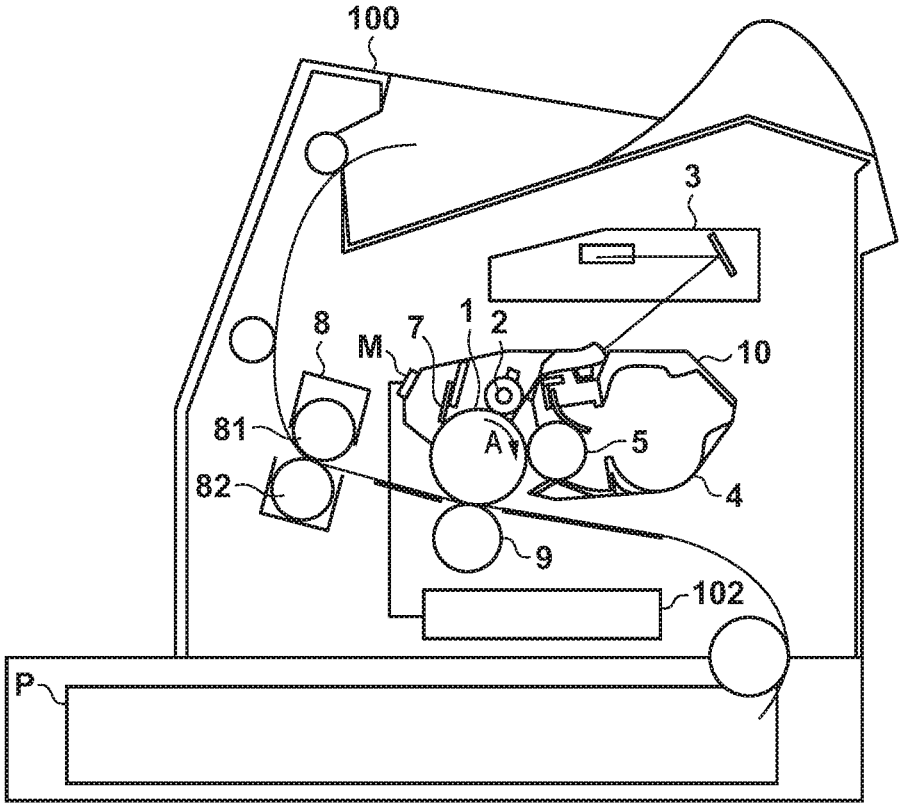
FIG. 1 is a cross-sectional view of a process cartridge type image forming apparatus according to a first embodiment.

FIG. 1 is a view illustrating an example of a schematic configuration of a process cartridge type image forming apparatus 100 to which the present invention can be applied. An image forming operation by the image forming apparatus 100 will be described below. In the following description of the number of colors of the developer and the structure of the housing portion configured for each color of the developer are omitted, but the image forming apparatus may correspond to a plurality of colors.

The photosensitive drum 1 is an image carrier, and when the image forming operation is started, it is rotationally driven in the direction of arrow A in the figure by a photosensitive member drive motor (not illustrated). The charging roller 2 is a charging device for charging the surface of the photosensitive drum 1, and a negative voltage is applied at a predetermined timing from a charging power supply (not illustrated), so that the photosensitive drum 1 is uniformly negatively charged. The laser exposure unit 3 is an exposure device for exposing the charged photosensitive drum 1, and forms an electrostatic latent image by exposing the surface of the photosensitive drum 1 with a laser beam according to image data. The developing roller 5 is a developer carrier disposed in the developing device 4 including a housing portion housing the developer T (hereinafter referred to as "Toner"). The electrostatic latent image on the photosensitive drum 1 is visualized as a toner image (developer image) by developing the electrostatic latent image by applying a developing bias to the developing roller 5.

On the other hand, a transfer material P such as paper is conveyed to a contact portion between the transfer roller 9 as a transfer device and the photosensitive drum 1 in time. The toner image visualized on the photosensitive drum 1 is transferred onto the transfer material P at this contact portion. A transfer bias is applied to the transfer roller 9 by a power source (not illustrated) between the transfer roller 9 and the photosensitive drum 1. The toner image transferred to the transfer material P is fixed to the transfer material P by the fixing device 8. The residual toner remaining on the photosensitive drum 1 without being transferred is collected by the cleaning device 7. By repeating such steps, the image forming operation is executed. Details are described below.

Transfer Device

The transfer roller 9 is provided so as to face the peripheral surface of the photosensitive drum 1 via the conveying path of the transfer material P. The transfer roller 9 is formed in a roller shape from a core metal member made of metal or the like and an elastic material as a support member thereof having excellent wear resistance, such as urethane rubber or silicone rubber and is in contact with the photosensitive drum 1 to form a transfer nip portion. A transfer bias can be applied to the transfer roller 9 via a core metal member by a power source (not illustrated). When the transfer material P is conveyed to the transfer nip portion, the toner image on the photosensitive drum 1 is electrostatically attracted, and the toner image shifts from the photosensitive drum 1 to the transfer paper P. In this case, a negatively charged toner is used, and a positive polarity bias, which is a reverse polarity of the toner, is applied as a transfer bias, so that the transfer process can be performed satisfactorily.

Fixing Device

The fixing device 8 applies heat and pressure to the image formed on the transfer material P to fix the toner image, and includes a fixing roller 81 and an elastic pressure roller 82. The elastic pressure roller 82 and the fixing roller 81 form a fixing nip portion having a predetermined width with a predetermined pressure contact force with a roller guide member (not illustrated). In a process in which the transfer material P on which the unfixed toner image is formed is nipped and conveyed through the fixing nip portion in a state where the fixing nip portion rises to a predetermined temperature and the temperature is adjusted, the unfixed toner image is fixed to the transfer material P.

Process Cartridge

In the process cartridge method illustrated in the present embodiment, the process cartridge 10 is formed by integrating the photosensitive drum 1, the charging roller 2, the developing device 4 containing the toner T, and the cleaning device 7. Moreover, the process cartridge 10 is configured to be detachably mounted in the main body of the image forming apparatus 100. The process cartridge 10 includes a storage device M capable of storing various kinds of information and providing information in response to a request.

Outline of Control of Image Forming Apparatus

Figure 2:
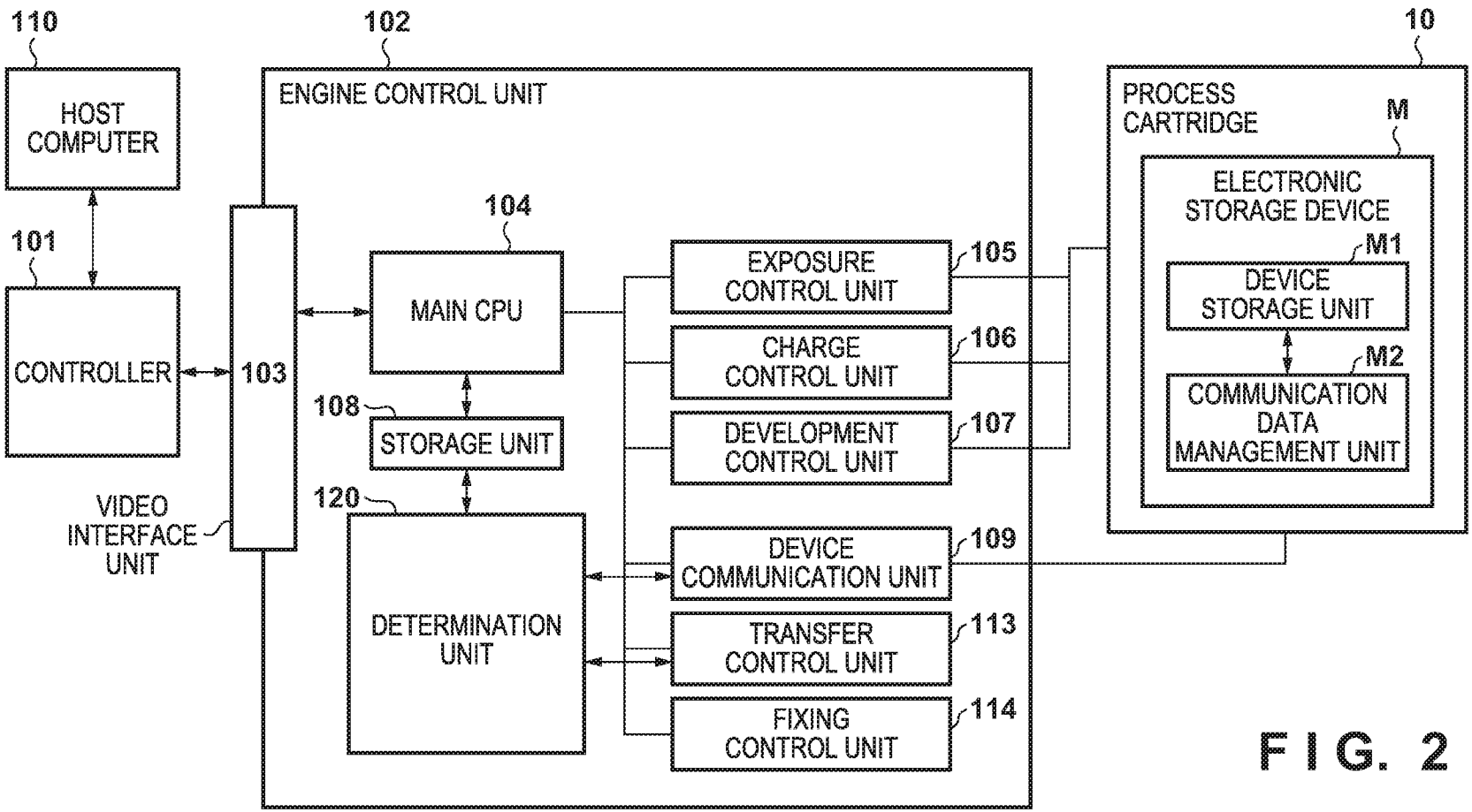
FIG. 2 illustrates an example of a configuration of the image forming apparatus according to the first embodiment.

The control according to the present embodiment will be described with reference to FIG. 2. In the present embodiment, the image forming apparatus 100 and a host computer 110 are communicably connected. The image forming apparatus 100 is configured so as to include a controller 101, and an engine control unit 102 that is controlled by the controller 101. Further, the image forming apparatus 100 is provided with a detachable process cartridge 10. The controller 101 and the engine control unit 102 are connected via a video interface unit 103. The video interface unit 103 is configured so as to include a serial communication unit and an image forming signal unit, both of which are not illustrated. The serial communication unit is used when the controller 101 transmits a command to the engine control unit 102 and the engine control unit 102 returns a status to the controller 101. The image forming signal unit is used for transmitting and receiving image data.

A main CPU 104 is a Central Processing Unit (CPU) that controls the entire engine control unit 102. The storage unit 108 includes a ROM, a RAM, an Electrically Erasable Programmable Read-Only Memory (EEPROM), or the like. The Read Only Memory (ROM) stores various control programs for executing each of flow charts described later. Additionally, the Random Access Memory (RAM) functions as a work area for temporarily storing various calculation results and data acquisition results when executing the flow chart described later.

In the example illustrated in the present embodiment, it is assumed that the configuration identification information indicating the shipping region is written and held in the EEPROM provided on the side of the main body of the image forming apparatus 100 at the time of manufacturing. Although the EEPROM is used in the present embodiment, the present invention is not limited thereto, and other storage means, for example, Non-Volatile RAM (NVRAM) or the like, may be used instead of the EEPROM.

The exposure control unit 105 controls exposure to the photosensitive drum 1. The charge control unit 106 performs control for applying a charging bias to the photosensitive drum 1. The development control unit 107 performs control for applying a development bias to the developing roller 5.

The device communication unit 109 acquires information stored in the storage device M in the process cartridge 10 through an interface (electrical contact portion not illustrated) provided in the main body of the image forming apparatus 100. The transfer control unit 113 performs control for applying a transfer bias in order to transfer the toner image on the photosensitive drum 1 to the transfer material P. The fixing control unit 114 performs energization control based on the detection result of a temperature detection element (not illustrated) provided around the fixing nip portion described above, and controls the fixing temperature at which the toner is fixed to the transfer material P.

The determination unit 120 determines whether to change the control based on the information acquired from the storage device M. In accordance with a determination that the control is to be changed, the determination unit 120 instructs to each control unit the control data changed based on the information obtained from the storage device M. In the example illustrated in the present embodiment, a case where a control parameter used for transfer control is changed will be described. Note that in FIG. 2, the determination unit 120 is provided separately from the main CPU 104 and indicates a configuration having a function equivalent to that of the main CPU 104.

Additionally, in the following description, the determination unit 120 basically performs various kinds of determination processing, but the present invention is not limited to this embodiment. For example, the determination unit 120 may perform various determination processing described later in cooperation with the main CPU 104, or may cause the main CPU 104 to perform all processings. The details of the processing performed by the determination unit 120 will be described later with reference to the drawings.

Storage Device

A storage device M provided in the process cartridge 10 according to the present embodiment will be described. The storage device M is configured so as to include a device storage unit M1 and a communication data management unit M2.

The device storage unit M1 stores information such as the date of manufacture of the process cartridge 10, the serial number, the number of prints counter, the remaining amount of toner, and parameters relating to process control (bias, etc.) for maintaining a good output image. For the above information, the process cartridge 10 is shipped in a state where the initial value is stored. In the present embodiment, the device storage unit M1 uses an EEPROM.

The communication data management unit M2 reads out the information stored in the device storage unit M1 based on the data sent from the device communication unit 109 provided in the engine control unit 102 on the main body side of the image forming apparatus 100, and returns the data to the device communication unit 109. In the present embodiment, an example in which the communication data management unit M2 uses a CPU is illustrated.

Storage device M is described with reference to FIGS. 3A to 3C. The storage device M is packaged in a predetermined shape covered with resin as illustrated in FIG. 3A, and includes an electrical contact portion S for communication with the main body of the image forming apparatus 100.

Further, it is assumed that the driving power supply in the storage device M is supplied from the main body side of the image forming apparatus 100 through the contact portion S.

FIG. 3B schematically illustrates the structure of information stored in the device storage unit M1. In the present embodiment, a configuration identification number indicating a shipping region and a transfer correction parameter corresponding to the configuration identification number are stored as a set in the device storage unit M1. The configuration identification number corresponds to the configuration identification information stored in the storage unit 108 of the image forming apparatus 100. The configuration identification information is, for example, defined for each shipping region by the manufacturer of the image forming apparatus 100 before shipment. However, the present invention is not limited to this, and may be defined according to the configuration and function of the mounted parts of the image forming apparatus 100. The transfer correction parameter is a control parameter (control information) indicating a voltage value for correcting the transfer bias applied by the transfer control unit 113 of the image forming apparatus 100. The communication data management unit M2 manages these 32 sets of data by assigning a serial number. Although the configuration identification number based on the shipping region is used in the present embodiment, the present invention is not limited to this. For example, an identification number corresponding to other classifications may be used. In the present embodiment, it is assumed that the data of each set is managed by serial numbers in order from the top. Here, 32 shipping regions are defined as the configuration identification numbers, but it is not limited to this and may be increased or decreased.

FIG. 3C illustrates a sequence diagram in which the determination unit 120 and the device communication unit 109, of the image forming apparatus 100, read out data from the storage device M of the process cartridge 10 mounted in the image forming apparatus 100 to correct the transfer bias. In the following description, an example in which "16" is stored as the configuration identification number of the image forming apparatus 100 in the storage unit 108 of the image forming apparatus 100 will be used.

In S311, the determination unit 120 reads out the configuration identification number from the storage unit 108. The return value of the result read out is assumed to be "0x10". Here, "0x" means a hexadecimal number, and "0x10" means "16" in a decimal number. In the following description, "0x" is prefixed when indicating a hexadecimal value, and the value is described as it is when indicating a decimal value.

In S312, the determination unit 120 and the device communication unit 109 transmit to the storage device M a parameter read instruction to which the configuration identification number "0x10" read out from the storage unit 108 is added.

In S313, when the communication data management unit M2 receives the parameter read instruction together with the configuration identification number from the device communication unit 109, the communication data management unit M2 reads out information corresponding to the received configuration identification number "0x10" from the device storage unit M1. In the example illustrated in FIG. 3B, as illustrated in information 301, the transfer correction parameter corresponding to the configuration identification number "0x10" is "20". That is, when this transfer correction parameter is expressed in hexadecimal, it is "0x14". As a result, the return value from the device storage unit M1 is "0x1014" in conjunction with the configuration identification number.

In S314, the communication data management unit M2 returns the return value "0x1014" to the device communication unit 109. For example, it is assumed that the transfer control unit 113 of the engine control unit 102 sets +1600V as the reference transfer bias. In this case, based on the above return value, the determination unit 120 arithmetically adds the correction parameter 20V returned from the storage device M and controls the transfer control unit 113 to apply +1620V (=+1600V+20V). If "0" is returned as the correction parameter, the correction is not performed.

Control Flow

Figure 4A:
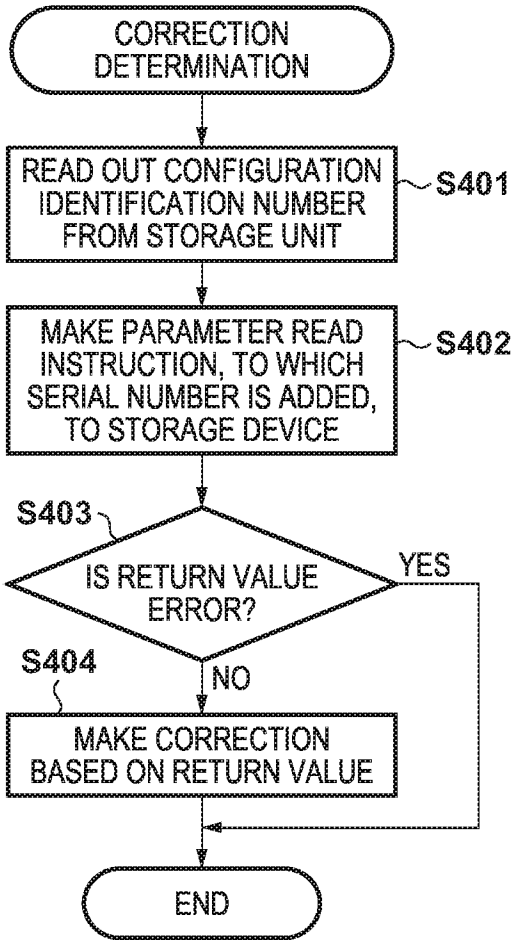
FIGS. 4A and 4B are flow charts of the control process according to the first embodiment.

FIG. 4A illustrates a control flow of the image forming apparatus 100 according to the present embodiment. In the present embodiment, when the power source of the main body of the image forming apparatus 100 is turned on, the storage device M provided in the process cartridge 10 and the device communication unit 109 of the image forming apparatus 100 enter a state in which communication can be started.

In S401, the determination unit 120 reads out the configuration identification number assigned to the image forming apparatus 100 from the storage unit 108.

In S402, the determination unit 120 transmits a parameter read instruction, to which a serial number is added, to the storage device M via the device communication unit 109. In the present embodiment, the serial number is the same value as the configuration identification number, and the serial number added in S402 is the configuration identification number read out from the storage unit 108 in S401. Then, the determination unit 120 receives a response to the parameter read instruction.

In S403, the determination unit 120 checks whether the return value returned from the storage device M is an error. If it is an error (YES in S403), the determination unit 120 does not correct the transfer bias. In this case, the present processing flow is terminated. If it is not an error (NO in S403), the process proceeds to S404.

In S404, the determination unit 120 corrects the transfer bias applied by the transfer control unit 113 based on the transfer correction parameter indicated by the return value returned. Then, the present processing flow is terminated.

Figure 4B:
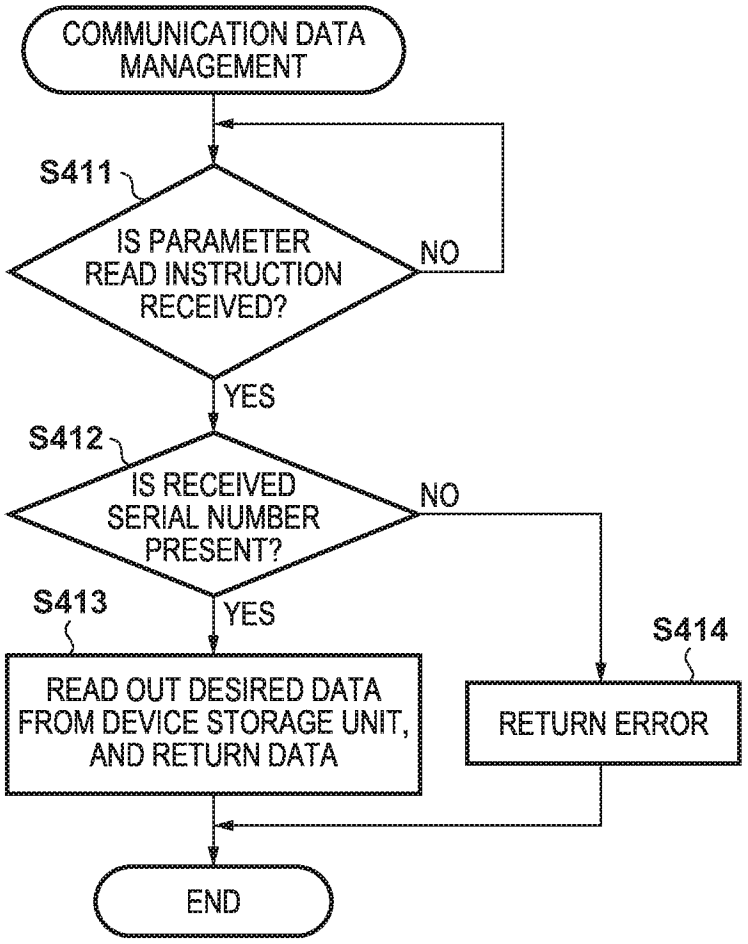

FIG. 4B illustrates a control flow of the communication data management unit M2 included in the storage device M according to the present embodiment.

In S411, the communication data management unit M2 determines whether a parameter read instruction is received from the main body side of the image forming apparatus 100. In accordance with a determination that the parameter read instruction is received (YES in S411), the process proceeds to S412, and in accordance with a determination that it is not received (NO in S411), the process waits until it is received.

In S412, the communication data management unit M2 determines whether the serial number added to the parameter read instruction is within the serial number range managed by the communication data management unit M2. In the case of the example illustrated in FIG. 3B, it is determined whether the serial number added is one of "1" to "32" in decimal. In accordance with a determination that it is within the range (YES in S412), the process proceeds to S413, and in accordance with a determination that not within the range (NO in S412), the process proceeds to S414.

In S413, the communication data management unit M2 reads out the transfer parameter corresponding to the configuration identification number of the added serial number from the device storage unit M1, and returns the data to the device communication unit 109 in response to the parameter read instruction. Then, the present processing flow is terminated.

In S414, the communication data management unit M2 returns an error to the device communication unit 109 in response to the parameter read instruction. When an error is returned, a value indicating the error may be defined in advance and the value may be returned. Then, the present processing flow is terminated.

Addition of Transfer Correction Parameters

Next, a method of adding a transfer correction parameter to the storage device M will be described. For example, the number of shipping regions that can be set at the start of production is 32, but new shipping regions are added after that, and it is assumed that correction needs to be performed with transfer correction parameters different from the conventional one in the new shipping regions.

Figures 5A, 5B:
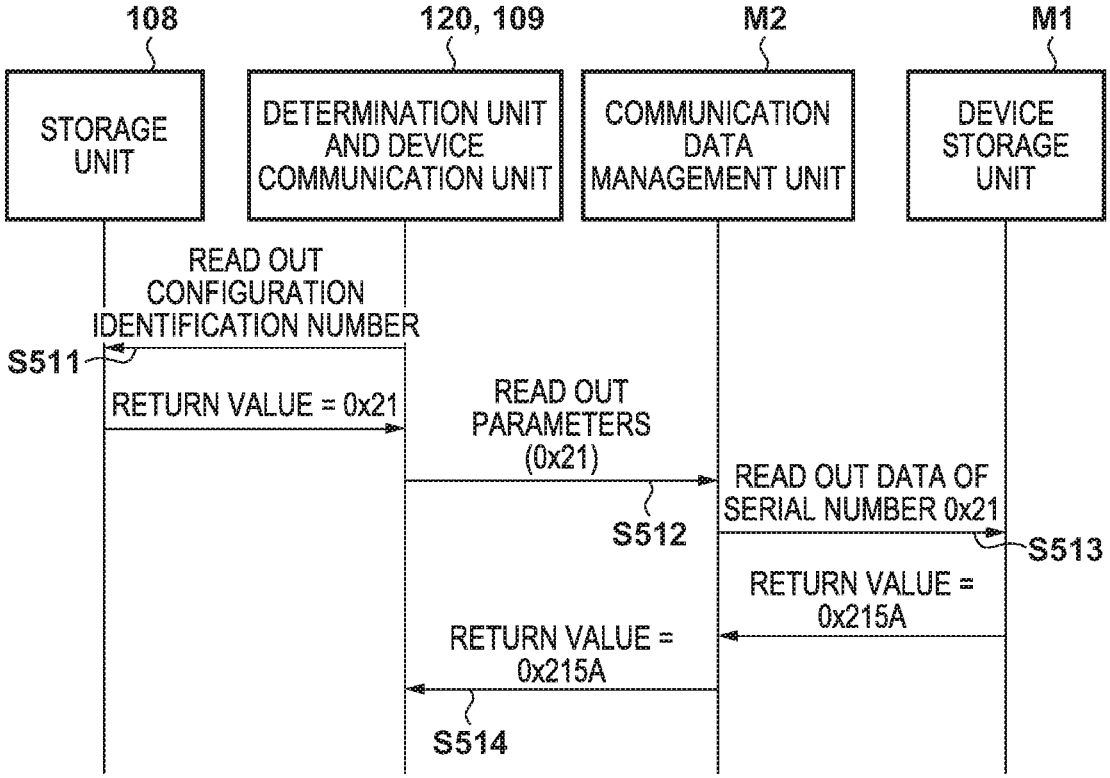
FIGS. 5A and 5B are diagrams illustrating an example of additional data configuration and a sequence of the storage device according to the first embodiment.

FIG. 5A illustrates an example in which a transfer correction parameter for a new shipping region is added to the information stored in the device storage unit M1 of FIG. 3B. In the present embodiment, an example of adding the configuration identification number and the transfer correction parameter illustrated in the information 501 will be described. Further, the communication data management unit M2 manages these 33 sets of data by adding a serial number. It is assumed that the process cartridge 10 including the storage device M containing the information 501 is shipped to the newly added shipping region.

FIG. 5B is a sequence diagram illustrating how the image forming apparatus 100 used in the new shipping region reads out data from the storage device M of the process cartridge 10 to correct the transfer bias. Moreover, here, the description will be made by using an example in which "33" is stored as the configuration identification number in the storage unit 108 of the image forming apparatus 100.

In S511, the determination unit 120 reads out the configuration identification number from the storage unit 108. It is assumed that the return value of the result read out is "0x21". That is, it means "33" in decimal.

In S512, the determination unit 120 and the device communication unit 109 transmit to the storage device M a parameter read instruction, to which the configuration identification number "0x21" read out from the storage unit 108 is added.

In S513, when the communication data management unit M2 receives a parameter read instruction together with a configuration identification number from the device communication unit 109, the communication data management unit M2 reads out information corresponding to the received configuration identification number "0x21" from the device storage unit M1. In the example illustrated in FIG. 5A, as illustrated in information 501, the transfer correction parameter corresponding to the configuration identification number "0x21" is "90". That is, when this transfer correction parameter is expressed in hexadecimal, it is "0x5A". As a result, the return value from the device storage unit M1 is "0x215A" in conjunction with the configuration identification number.

In S514, the communication data management unit M2 returns the return value "0x215A" to the device communication unit 109. For example, it is assumed that the transfer control unit 113 of the engine control unit 102 sets +1600V as the reference transfer bias. In this case, based on the return value, the determination unit 120 arithmetically adds the correction parameter 90V returned from the storage device M and controls the transfer control unit 113 to apply +1690V (=+1600V+90V).

As described above, according to the present embodiment, the image forming apparatus can obtain a desired transfer correction parameter by only performing one data communication with a small amount of data with the storage device, and can set an appropriate image forming condition. Therefore, the control parameters corresponding to the configuration of the image forming apparatus in which the process cartridge is mounted from the many control parameters stored in the storage device can be obtained by data communication with a small load. In addition, according to the present embodiment, even when the identification information of a new shipping region and the transfer correction parameter are added, an appropriate image forming condition can be set without changing the control method.

Further, although parameters related to transfer control have been described as examples in the above examples, the present invention may be applied to other control parameters. Although FIG. 3B illustrates an example in which a configuration identification number and one control parameter are stored in association with the configuration identification number, a plurality of control parameters may be stored in association with a configuration identification number.

In the above example, the configuration in which different control parameters are associated with each configuration identification number is illustrated, but for example, configuration identification numbers are indicated by a range, and a configuration may be such that the control parameter are associated with the rage. Thus, the amount of data held on the process cartridge side can be reduced.

Second Embodiment

In the present embodiment, when the process condition for image formation is changed based on the parameter stored in the storage device of the process cartridge, a configuration in which the authentication of the storage device is performed to determine that the data is a valid value will be described. Note that the same configuration as that of the first embodiment will be omitted from description.

In the present embodiment, a message authentication code using a common key cryptography is employed as a general authentication method. Further, in the image forming apparatus according to the present embodiment, since the authentication information stored in the storage device is used as a part of the common key, it is necessary to acquire the authentication information of the storage device. Although the present embodiment illustrates an example of using the common key cryptography, the present invention is not limited to this, and other authentication means, for example, verification using the public key cryptography or hash function, may be used.

FIG. 6A schematically illustrates the structure of information stored in the device storage unit M1. In the present embodiment, the device storage unit M1 stores a model identification number uniquely indicating a model, a configuration identification number uniquely indicating a shipping region, and authentication information corresponding to the configuration identification number as a set. The model identification information and the configuration identification number correspond to the model identification information and the configuration identification information stored in the storage unit 108 of the image forming apparatus 100. In the present embodiment, two identification numbers, i.e., a model identification number based on a model and a configuration identification number based on a shipping region, are used, but the present invention is not limited to this. For example, identification numbers corresponding to more classifications may be used. In the present embodiment, the data of each set is managed by serial numbers in order from the top. The authentication information is the data which the determination unit 120 of the image forming apparatus 100 uses as part of the common key during the authentication determination. Although not illustrated in FIG. 6A, the control parameters may be further associated as illustrated in FIG. 5A.

The information 601 includes authentication information used for authentication determination when the process cartridge is mounted to a model A. It is assumed that the model A is represented by a model identification number "1", and that the configuration identification number is only "1". The information 602 includes authentication information used for authentication determination when the process cartridge is mounted to a model B. It is assumed that a model B is represented by a model identification number "2", and that the configuration identification number is present from "1" to "16". The information 603 includes authentication information used for the authentication determination when the process cartridge is mounted to a model C. It is assumed that the model C is represented by the model identification number "3", and that the configuration identification number is present from "1" to "32". It is assumed that the communication data management unit M2 manages these 49 sets of data by adding a serial number corresponding to each model.

Figure 6B:
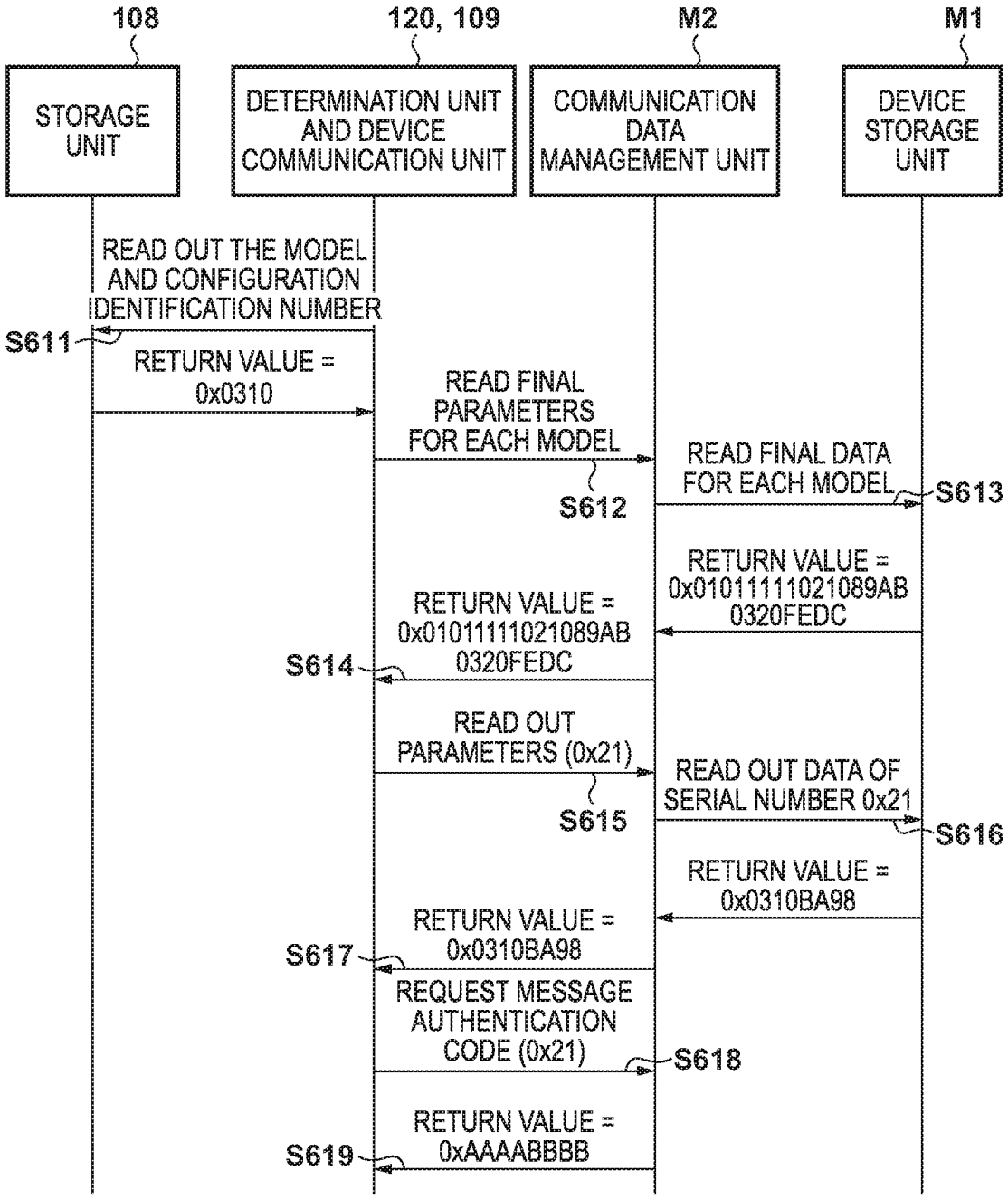

FIG. 6B illustrates a sequence diagram in which the determination unit 120 and the device communication unit 109, of the image forming apparatus 100, read and authenticate the data of the storage device M of the process cartridge 10 mounted in the image forming apparatus 100. Here, an example will be described below, in which the image forming apparatus 100 is a model C, and the storage unit 108 stores "3" as a model identification information, and "16" is stored as a configuration identification number.

In S611, the determination unit 120 and the device communication unit 109 read out the model identification information and the configuration identification number from the storage unit 108. It is assumed that the return value of the result read out is "0x0310" based on the above number.

In S612, the determination unit 120 and the device communication unit 109 transmit to the storage device M an instruction to read out the final parameters for each model. The instruction to read out the final parameters for each model is to request the value of the last configuration identification number and the value of the authentication information corresponding to that configuration identification number among the values associated with each model stored in the storage device M. In this example, the configuration identification number at the end of each model identification number is acquired based on the model identification number, but the present invention is not limited to this.

In S613, when the communication data management unit M2 receives an instruction to read out the final parameters for each model from the device communication unit 109, the communication data management unit M2 reads out the authentication information corresponding to the final number of the configuration identification number for each model identification number from the device storage unit M1. In the example illustrated in FIG. 6A, the configuration identification number "1" (="0x01") and the authentication information "0x1111" are read out from the information 604 as values corresponding to the model identification number "1". Similarly, as values corresponding to the model identification numbers "2" and "3", the configuration identification number "16" (="0x10") and the authentication information "0x89AB" are read out from the information 605, and the configuration identification number "32" (="0x20") and the authentication information "0xFEDC" are read out from the information 606.

In S614, the communication data management unit M2 returns the data "0x01011111021089AB0320FEDC" obtained by concatenating the data read out in S613 to the device communication unit 109 as a return value.

In S615, the determination unit 120 and the device communication unit 109 determine whether their own model identification number is included in the return value from the storage device M. As described above, here since the model identification number of the image forming apparatus 100 is "3", it is determined whether this is included in the return value. As a result, the determination unit 120 determines that the model identification number "03" is included in the return value, and calculates the serial number. Specifically, it can be specified from the return value that the number of components of the model identification number "1" (="0x01") is "1" (="0x01"), the number of components of the model identification number "2" (="0x02") is "16" (="0x10"), and the number of components of the model identification number "3" (="0x03") is "32" (="0x20"). Since the configuration identification number to be obtained is the configuration identification number "0x10" (="16") of the model identification number "3", the serial number is determined as "0x21" (="33"="1"+"16"+"16").

In S616, when the communication data management unit M2 receives a parameter read instruction together with a serial number from the device communication unit 109, the communication data management unit M2 reads out information, corresponding to the received serial number "0x21", from the device storage unit M1. In the example illustrated in FIG. 6A, as illustrated in information 607, the authentication information corresponding to the serial number "0x21" is "0xBA98". As a result, the return value from the device storage unit M1 is "0x0310BA98" in conjunction with the model identification number and serial number.

In S617, the communication data management unit M2 returns the return value "0x0310BA98" to the device communication unit 109.

Next, in S618, the determination unit 120 adds a serial number (in this example, "0x21") and requests a message authentication code to the storage device M.

In S619, the communication data management unit M2 uses, as a part of the common key, the authentication information "0xBA98" corresponding to the serial number "0x21" added to the message authentication code request transmitted from the device communication unit 109. As an example, "0xAAAA" may be used as a message, and this value may be stored in advance on the side of the communication data management unit M2. The communication data management unit M2 calculates a message authentication code by the common key authentication method from the message "0xAAAA" and the common key (in this example, the common key partially including the authentication information "0xBA98"). Here, it is assumed that a message authentication code "0xBBBB" has been calculated. The communication data management unit M2 concatenates the message "0xAAAA" and the message authentication code "0xBBBB" as a response corresponding to the message authentication code request, and returns "0xAAAABBBB" as a return value to the device communication unit 109.

Further, similarly, the determination unit 120 uses, as a part of the common key, the value (in this example, "0xBA98") of the authentication information obtained as a response to the parameter read instruction. Then, the determination unit 120 calculates the message authentication code from the message "0xAAAA" and the common key (including partially "0xBA98" in this example) based on the value returned by the storage device M as the return value of the message authentication code request. As a result, when the message authentication code calculated by the determination unit 120 itself coincides with the message authentication code (in this case, "0xBBBB") indicated by the return value of the message authentication request, the determination unit 120 determines that the authentication is successful.

Based on the above authentication result, the processing of FIG. 3C of the first embodiment may be performed, for example. Alternatively, the control parameters may be acquired together in the sequence of FIG. 6B.

Control Flow

Figure 7A:
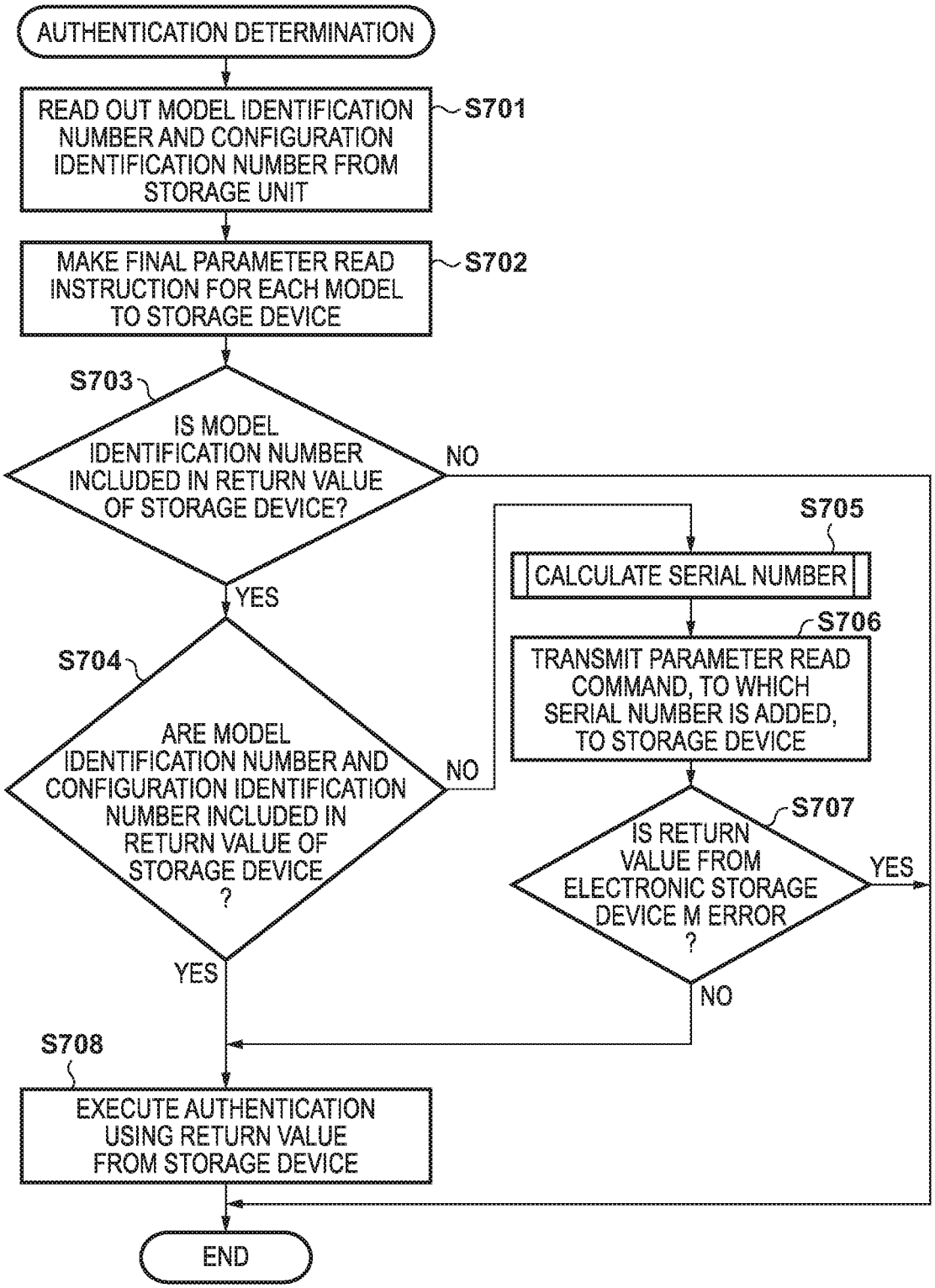
FIGS. 7A to 7C are flow charts of the control process according to the second embodiment.

FIG. 7A illustrates a control flow of the image forming apparatus 100 according to the present embodiment. In the present embodiment, when the power source of the main body of the image forming apparatus 100 is turned on, the storage device M provided in the process cartridge 10 and the device communication unit 109 of the image forming apparatus 100 enter a state in which communication can be started.

In S701, the determination unit 120 reads out the model identification number and the configuration identification number from the storage unit 108.

In S702, the determination unit 120 transmits an instruction to read out the final parameters for each model to the storage device M via the device communication unit 109. Then, the determination unit 120 receives a response to the instruction to read out the final parameters for each model.

In S703, the determination unit 120 checks whether the model identification number read out in S701 is included in the return value returned from the storage device M. In accordance with a determination that it is included (YES in S703), the process proceeds to S704. In accordance with a determination that it is not included (NO in S703), the determination unit 120 determines that the authentication error occurs, and terminates the present processing flow.

In S704, the determination unit 120 checks whether the model identification number and the configuration identification number read out in S701 are included in the return value returned from the storage device M. In accordance with a determination that it is included (YES in S704), the process proceeds to S708, and in accordance with a determination that it is not included (NO in S704), the process proceeds to S705.

In S705, the determination unit 120 calculates the serial number from the return value returned from the storage device M and the model identification number and the configuration identification number read out in S701. The details of the processing for calculating the serial number in the present processing will be described later with reference to FIG. 7B.

In S706, the determination unit 120 transmits a parameter read instruction, to which a serial number is added, to the storage device M.

In S707, the determination unit 120 checks whether the return value returned from the storage device M is an error. If it is an error (YES in S707), the determination unit 120 determines that it is an authentication error and terminates the present processing flow. If it is not an error (NO in S707), the process proceeds to S708.

In S708, the determination unit 120 executes the authentication process using the returned authentication number. Thereafter, the present processing flow is terminated.

Serial Number Calculation Processing

Figure 7B:
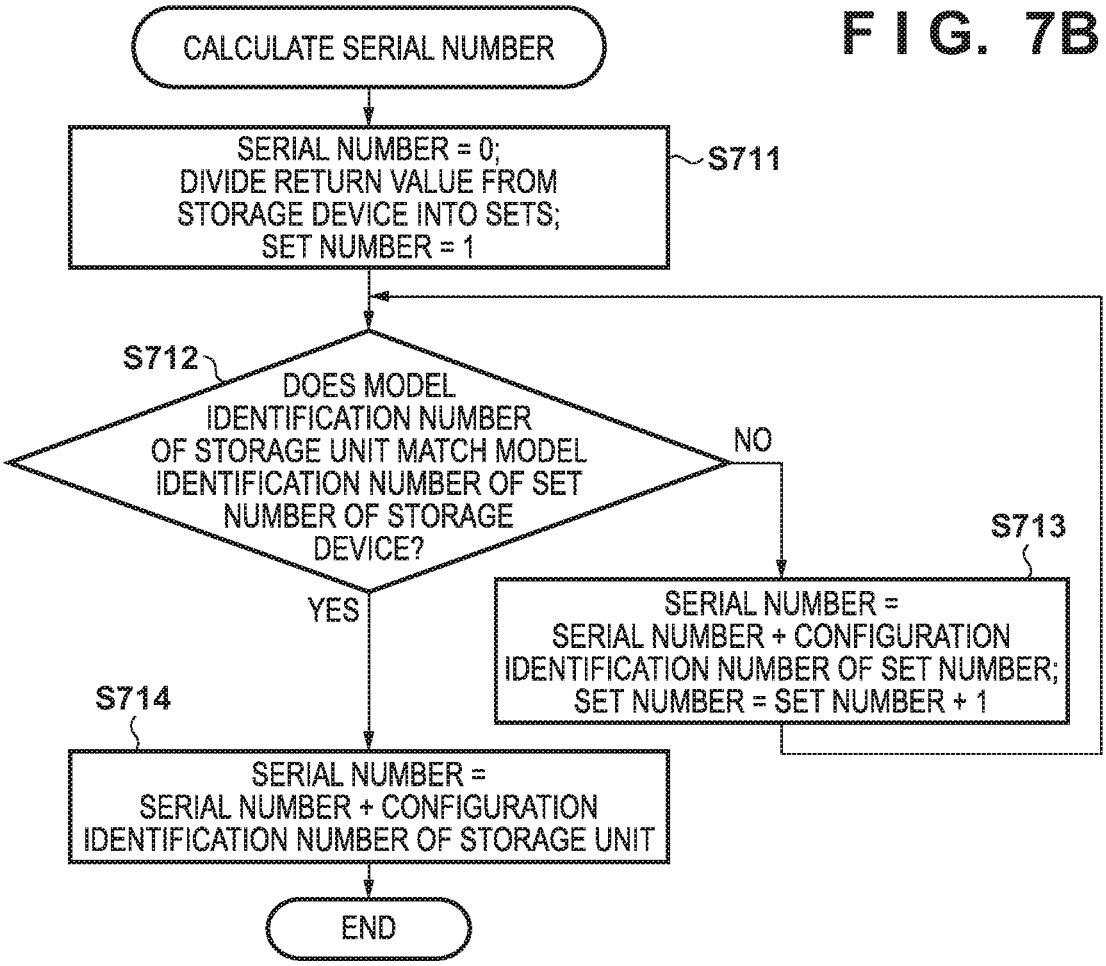

FIG. 7B illustrates a control flow of the serial number calculation of the image forming apparatus 100 according to the present embodiment. This processing flow corresponds to S705 in FIG. 7A.

In S711, the determination unit 120 substitutes (initialize) "0" for the serial number as a variable. The determination unit 120 divides the return value (return value of S614 in FIG. 6B) from the storage device M into sets. Further, the determination unit 120 substitutes (initialize) "1" for the set number as a variable.

In S712, the determination unit 120 checks whether the model identification number read out from the storage unit 108 matches the model identification number of the set number read out from the storage device M. In accordance with a determination that they match (YES in S712), the process proceeds to S714, and in accordance with a determination that they do not match (NO in S712), the process proceeds to S713.

In S713, the determination unit 120 arithmetically adds the configuration identification number of the set number read out from the storage device M to the serial number (variable). The determination unit 120 arithmetically adds "1" to the set number (variable). Thereafter, the process returns to S712, and the process is repeated until the model identification numbers match.

In S714, the determination unit 120 arithmetically adds the configuration identification number read out from the storage unit 108 to the serial number (variable). Then, the present processing flow is terminated, and the process proceeds to S706 in FIG. 7A.

Processing to Read Out the Final Parameters for Each Model

Figure 7C:
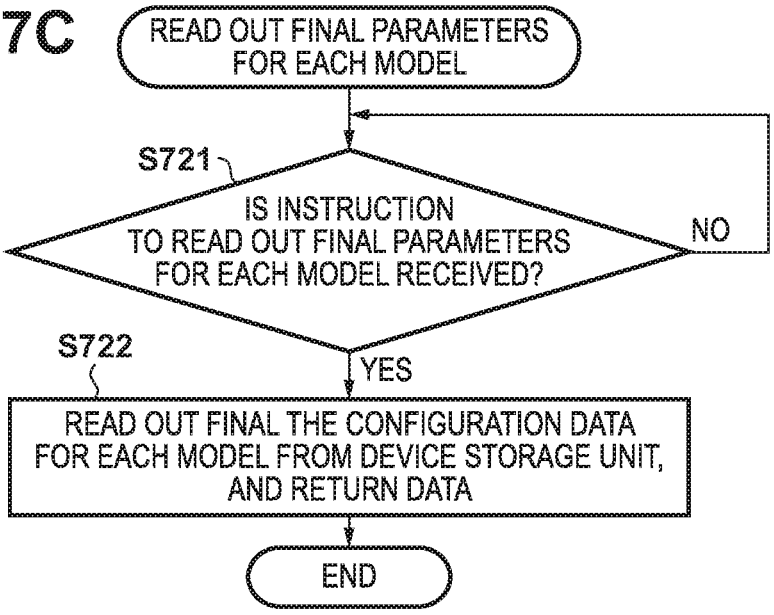

FIG. 7C illustrates a control flow of the processing to read out the final parameters for each model by the communication data management unit M2 of the storage device M according to the present embodiment. This processing flow corresponds to S616 in FIG. 6B.

In S721, the communication data management unit M2 determines whether an instruction to read out the final parameters for each model is received. In accordance with a determination that the instruction to read out the final parameters for each model is received (YES in S721), the process proceeds to S722, and in accordance with a determination that it is not (NO in S721), the process waits until the instruction is received.

In S722, the communication data management unit M2 reads out the authentication information corresponding to the final number of the configuration identification number for each model identification number from the device storage unit M1. The specific example here is described with reference to FIG. 6B. Thereafter, the determination unit 120 returns the data read out to the device communication unit 109. Then, the present processing flow is terminated.

In addition, the control flow of the parameter reading by the communication data management unit M2 of the storage device M according to the present embodiment is as described with reference to FIG. 4B of the first embodiment.

As described above, according to the present embodiment, the image forming apparatus can acquire desired authentication information by executing data communication with a small amount of data with the process cartridge a small number of times, and can perform authentication control.

Third Embodiment

In the second embodiment, a method of obtaining desired authentication information by performing data communication twice has been described. In the present embodiment, a method of acquiring desired authentication information by one data communication and using it for authentication control will be described in a case where the model identification information stored in the storage device includes the model that has been produced in the past and the number of the configurations of these models does not increase. A detailed description of the same configuration as in the first and second embodiments is omitted here.

It is assumed that the structure of information stored in the device storage unit M1 is the same as that illustrated in FIG. 6A of the second embodiment. Hereinafter, an example will be described in which the configurations of the model A of the information 601 and the configurations of the model B of the information 602 may not increase and the configuration number of the model C of the information 603 may increase. Also, it is assumed that the storage unit 108 of the image forming apparatus 100 stores the total of the number of configurations of the model A and the model B as the number of configuration offset. That is, the number of pieces of configuration identification information for image forming apparatus of the models A and B is treated as a fixed value. For example, in the example illustrated in FIG. 6A, the number of configuration offset is "17" (=Number of configurations of Model A "1"+Number of configurations of Model B "16").

Control Flow

Figure 8:
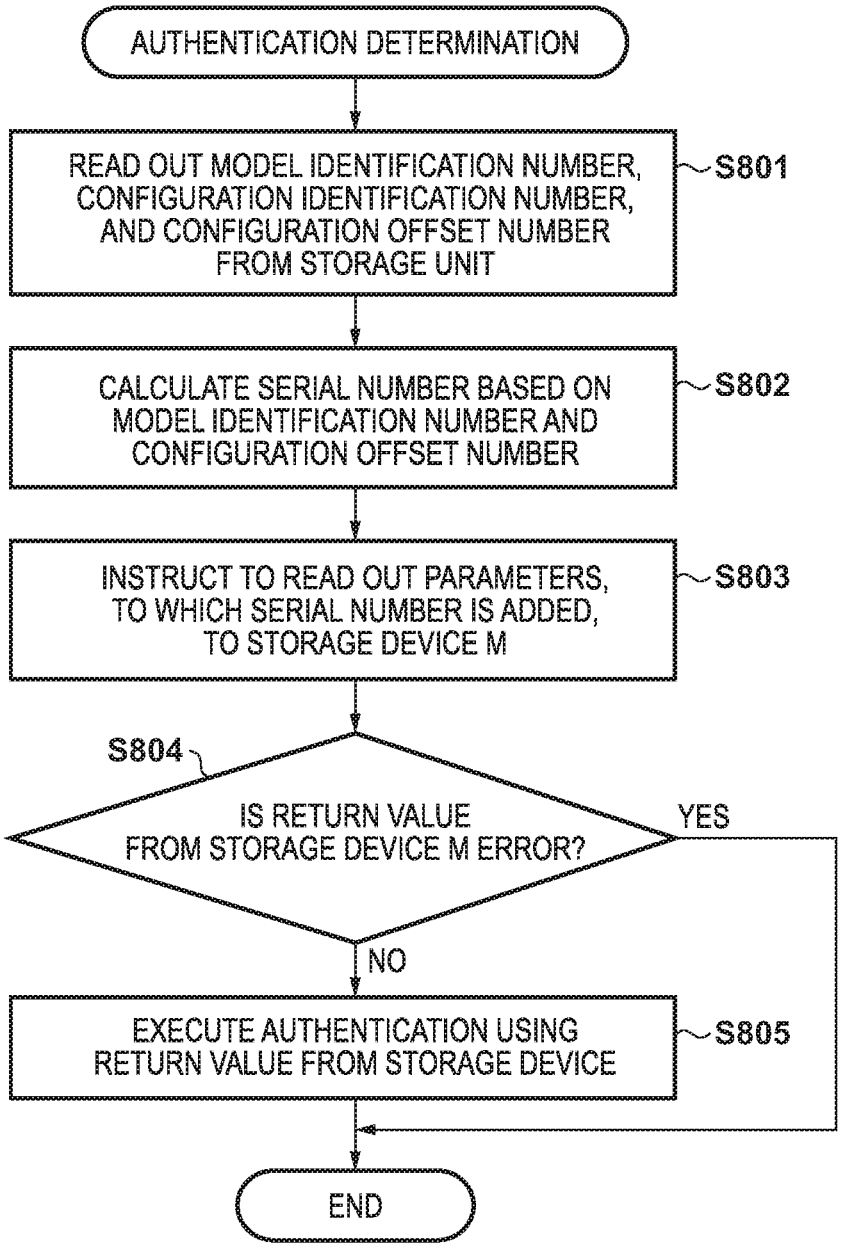
FIG. 8 is a flow chart of the control process according to a third embodiment.

FIG. 8 illustrates a control flow of the image forming apparatus 100 according to the present embodiment. In the present embodiment, when the power source of the main body of the image forming apparatus 100 is turned on, the storage device M provided in the process cartridge 10 and the device communication unit 109 of the image forming apparatus 100 enter a state in which communication can be started.

In S801, the determination unit 120 reads out the model identification number, the configuration identification number, and the configuration offset number from the storage unit 108.

In S802, the determination unit 120 calculates the serial number. The serial number calculated here is the sum of the configuration identification number and the configuration offset number, which are read out from the storage unit 108 in S801.

In S803, the determination unit 120 transmits, via the device communication unit 109, a parameter read instruction to which the serial number calculated in S802 is added, to the storage device M. Then, the determination unit 120 receives a response to the parameter read instruction.

In S804, the determination unit 120 checks whether the return value returned from the storage device M is an error. If it is an error (YES in S804), the determination unit 120 determines that it is an authentication error and terminates the present processing flow. If it is not an error (NO in S804), the process proceeds to S805.

In S805, the determination unit 120 executes an authentication process using the returned authentication number. Thereafter, the present processing flow is terminated.

The control flow of parameter reading by the communication data management unit M2 of the storage device M according to the present embodiment is as described with reference to FIG. 4B of the first embodiment.

As described above, according to the present embodiment, the image forming apparatus can acquire desired authentication information by executing one data communication with a small amount of data with the process cartridge, and can perform authentication control.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-210926, filed on Nov. 8, 2018, which is hereby incorporated by reference herein in its entirety.

What is claimed is:

1. An image forming apparatus in which a process cartridge is detachably mounted, wherein the image forming apparatus comprises:

a holding unit configured to hold specific identification information, and an acquisition unit configured to, with the specific identification information held in the holding unit, acquire from the process cartridge control information that is related to control of the image forming apparatus, the control information corresponding to the specific identification information, wherein the process cartridge comprises:

a storage unit configured to store a plurality of sets of information that associate a plurality of pieces of identification information corresponding to a plurality of image forming apparatuses with a plurality of pieces of control information, the plurality of pieces of identification information including the specific identification information; and a management unit configured to manage the plurality of sets of information with assigned serial numbers and to provide the acquisition unit with information stored in the storage unit, and wherein the acquisition unit uses one of the serial numbers to acquire the control information corresponding to the specific identification information from among the plurality of sets of information stored in the storage unit.

2. The image forming apparatus according to claim 1, wherein the management unit receives a request to which the specific identification information is added from the acquisition unit, and provides the acquisition unit with the control information corresponding to the specific identification information in response to the request.

3. The image forming apparatus according to claim 1, wherein the identification information is assigned a different value depending on a shipping region or a mounted part of the image forming apparatus.

4. The image forming apparatus according to claim 1, wherein the process cartridge includes a member for forming an image.

5. The image forming apparatus according to claim 1, wherein the process cartridge includes a photosensitive member, a charging member, a developing member, and a cleaning member.

6. The image forming apparatus according to claim 1, wherein the control information is a correction parameter of an image forming operation corresponding to the image forming apparatus.

7. The image forming apparatus according to claim 1, wherein the control information is information used for authentication of the process cartridge mounted in the image forming apparatus, and wherein the image forming apparatus further includes an authentication unit configured to use the control information to authenticate whether the information acquired from the process cartridge is valid.

8. The image forming apparatus according to claim 1, wherein each piece of the identification information has the same value as a corresponding one of the serial numbers.

9. The image forming apparatus according to claim 1, wherein the management unit determines whether or not the serial number provided from the acquisition unit is within a serial number range for assignment by the management unit.

* * * * *